US010672374B2

(12) United States Patent
Ichiki

(10) Patent No.: US 10,672,374 B2
(45) Date of Patent: Jun. 2, 2020

(54) KEYBOARD APPARATUS

(71) Applicant: YAMAHA CORPORATION, Hamamatsu-shi (JP)

(72) Inventor: Shunsuke Ichiki, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 16/392,706

(22) Filed: Apr. 24, 2019

(65) Prior Publication Data

US 2019/0251939 A1 Aug. 15, 2019

Related U.S. Application Data

(63) Continuation of application No. PCT/JP2017/038738, filed on Oct. 26, 2017.

(30) Foreign Application Priority Data

Oct. 28, 2016 (JP) ..... 2016-211352

(51) Int. Cl.
*G10H 1/34* (2006.01)
*G10C 3/12* (2006.01)
*G10B 3/12* (2006.01)

(52) U.S. Cl.
CPC ..... *G10H 1/346* (2013.01); *G10B 3/12* (2013.01); *G10C 3/12* (2013.01); *G10H 1/34* (2013.01); *G10H 2220/221* (2013.01); *G10H 2220/275* (2013.01)

(58) Field of Classification Search
CPC .... G10H 1/346; G10H 1/34; G10H 2220/275; G10H 2220/221; G10B 3/12; G10C 3/12; G10C 3/16
See application file for complete search history.

(56) References Cited

U.S. PATENT DOCUMENTS 5,955,690 A 9/1999 Yoshinaga
2020/0075271 A1* 3/2020 Wu ..... H01H 13/86

FOREIGN PATENT DOCUMENTS

JP H06318076 A 11/1994
JP 2008191650 A 8/2008

OTHER PUBLICATIONS

International Search Report issued in Intl. Appln. No. PCT/JP2017/038738 dated Dec. 26, 2017. English translation provided.
Written Opinion issued in Intl. Appln. No. PCT/JP2017/038738 dated Dec. 26, 2017.

* cited by examiner

*Primary Examiner* — Kimberly R Lockett
(74) *Attorney, Agent, or Firm* — Rossi, Kimms & McDowell LLP

(57) ABSTRACT

According to an embodiment of the present invention, a keyboard apparatus includes a key, a frame, and a connecting portion having a first flexible portion, a second flexible portion serially connected to the first flexible portion between the key and the frame, and a connector for connecting the first flexible portion and the second flexible portion to each other attachably and detachably, the connecting portion turnably connecting the key to the frame by utilizing flexibility of the first flexible portion or the second flexible portion.

21 Claims, 13 Drawing Sheets

KEYBOARD APPARATUS

CROSS REFERENCE TO RELATED APPLICATIONS

This application is a U.S. continuation application filed under 35 U.S.C. § 111(a), of International Application No. PCT/JP2017/038738, filed on Oct. 26, 2017, which claims priority to Japanese Patent Application No. 2016-211352, filed on Oct. 28, 2016, the disclosures of which are incorporated by reference.

FIELD

The present invention relates to a keyboard apparatus.

BACKGROUND

As one example of a structure of turning a key in a keyboard apparatus, there is a structure where a thin plate having flexibility is arranged horizontally (e.g., PTL 1: Japanese Patent Application Laid-Open No. 2008-191650). By deforming this thin plate, the key can be turned in upward and downward directions. In PTL 1, a structure that by further using another thin plate arranged vertically concurrently and serially connecting the same to the thin plate arranged horizontally, movement in a direction in which keys are arrayed can be allowed is also disclosed.

SUMMARY

According to an embodiment of the present invention, a keyboard apparatus includes a key, a frame, and a connecting portion having a first flexible portion, a second flexible portion serially connected to the first flexible portion between the key and the frame, and a connector for connecting the first flexible portion and the second flexible portion to each other attachably and detachably, the connecting portion turnably connecting the key to the frame by utilizing flexibility of the first flexible portion or the second flexible portion is provided.

According to an embodiment of the present invention, a keyboard apparatus includes a key, a frame, and a connecting portion having a first flexible portion, and a second flexible portion different in material from the first flexible portion and serially connected to the first flexible portion between the key and the frame, the connecting portion turnably connecting the key to the frame by utilizing flexibility of the first flexible portion or the second flexible portion is provided.

DESCRIPTION OF EMBODIMENTS

Figure 1:
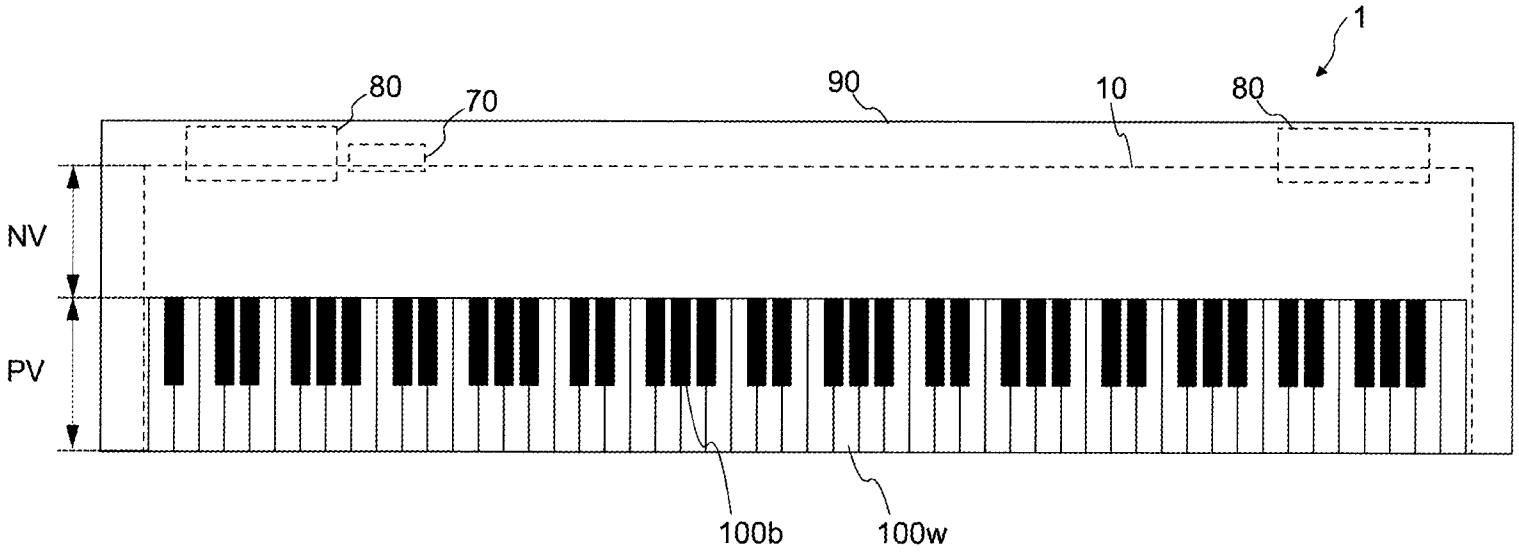
FIG. 1 is a view showing a configuration of a keyboard apparatus according to a first embodiment.

A keyboard apparatus according to one embodiment of the present invention will be hereinafter described in detail with reference to the drawings. The embodiment described below is an example of the embodiment of the present invention, and the present invention should not be interpreted as being limited to such embodiment. In the figures referenced in the present embodiment, the same reference numeral or similar reference numeral (reference numeral simply added with A, B etc. after the number) is denoted on the same portion or the portion having similar function, and redundant description is sometimes omitted. Furthermore, a dimensional ratio (ratio between each configuration, ratio in longitudinal, lateral and height direction, etc.) of the figure may be different from the actual ratio, or one part of the configuration may be omitted from the figure for the sake of convenience of explanation.

According to the structure disclosed in PTL 1 (Japanese Patent Application Laid-Open No. 2008-191650), the key and the thin plate are molded integrally. According to such a structure, manufacturing is made easy. On the other hand, since the key and the thin plate are configured to have an integrated structure made from the same material, it is necessary to control a degree of deformation occurring from flexibility by the shapes of the key and the thin plate. Therefore, in such a structure, it was difficult to obtain a touch feeling such as a touch feeling obtained by an acoustic piano. It is to be noted that the touch feeling means a predetermined feeling provided to a finger of a player through the key during a pushing of the key. For example, the touch feeing obtained by the acoustic piano is generated by a movement of an action mechanism.

According to a keyboard apparatus according to one embodiment described below, a degree of freedom for design of the touch feeling can be improved.

First Embodiment

[Configuration of Keyboard Apparatus]

FIG. 1 is a view showing a configuration of a keyboard apparatus according to a first embodiment. In this example, a keyboard apparatus 1 is an electronic keyboard musical instrument that outputs a sound in response to the pushing of a key by a user (player) such as an electronic piano. The keyboard apparatus 1 may be a keyboard type controller that outputs control data (e.g., MIDI) for controlling an external sound source device in response to the pushing of the key. In this case, the keyboard apparatus 1 may not include the sound source device.

The keyboard apparatus 1 includes a keyboard assembly 10. The keyboard assembly 10 includes a white key 100*w* and a black key 100*b*. A plurality of white keys 100*w* and a plurality of black keys 100*b* are arrayed side by side. The number of keys 100 is N, and is 88 in this example, but the number of keys is not limited thereto. A direction in which the keys 100 are arrayed is called a scale direction. When a description can be made without particularly distinguishing the white key 100*w* and the black key 100*b*, the white key 100*w* and the black key 100*b* are sometimes referred to as the key 100. In the following description, the configuration with "w" denoted at the end of the reference numeral is the configuration corresponding to the white key. The configuration with "b" denoted at the end of the reference numeral is the configuration corresponding to the black key.

One part of the keyboard assembly 10 exists inside a housing 90. When the keyboard apparatus 1 is seen from above, a portion of the keyboard assembly 10 covered by the housing 90 is referred to as a non-appearing portion NV, and a portion exposed from the housing 90 and visible from the user is referred to as an appearing portion PV. In other words, the appearing portion PV indicates a region constituting one part of the key 100 that can be played and operated by the user. Hereinafter, a portion of the key 100 exposed by the appearing portion PV is sometimes referred to as a key main body portion.

A sound source device 70 and a speaker 80 are arranged inside the housing 90. The sound source device 70 generates a sound waveform signal accompanying the pushing of the key 100. The speaker 80 outputs the sound waveform signal generated by the sound source device 70 to an external space. The keyboard apparatus 1 may include a slider for controlling the volume, a switch for switching the tone, a display for displaying various information, and the like.

In the description of the present specification, directions such as up, down, left, right, near, far, and the like are directions of when the keyboard apparatus 1 is seen from the player when playing. For example, the non-appearing portion NV can be expressed as being located on the far side from the appearing portion PV. The direction may be indicated with the key 100 as the reference such as a key front end side (key front side) and key back end side (key back side). In this case, the key front end side indicates the near side seen from the player with respect to the key 100. The key back end side indicates the far side seen from the player with respect to the key 100. According to the definition described above, in the black key 100*b*, the front end to the back end of the key main body portion of the black key 100*b* can be expressed as being a portion projecting out toward the upper side from the white key 100*w*.

Figure 2:
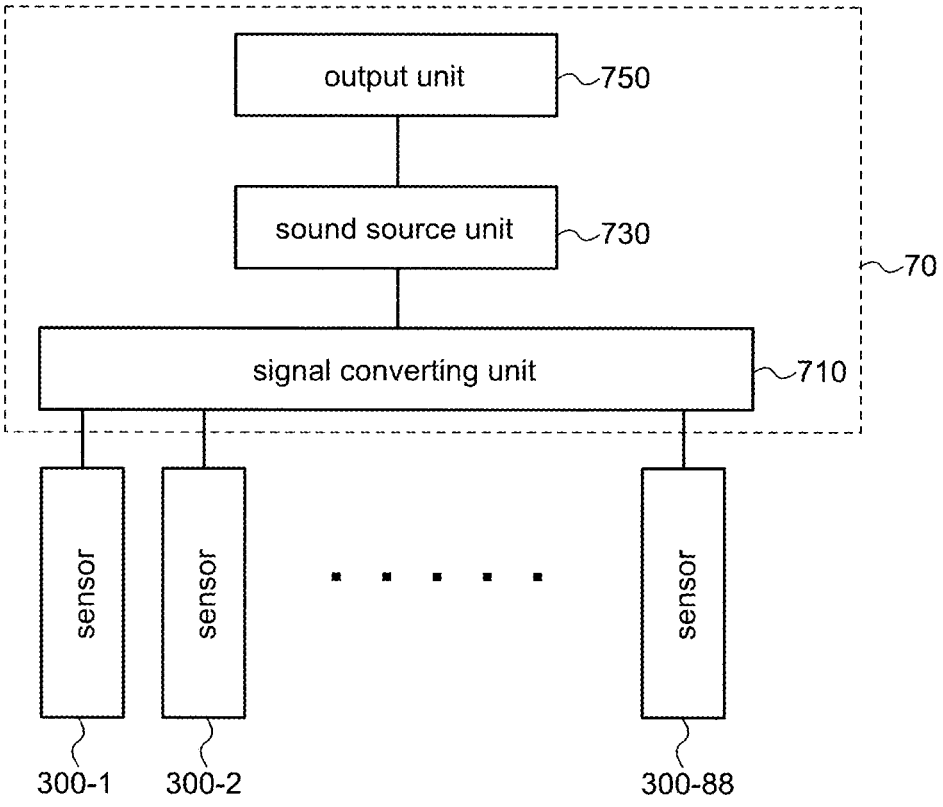
FIG. 2 is a block diagram showing a configuration of a sound source device according to the first embodiment.

FIG. 2 is a block diagram showing a configuration of the sound source device in the first embodiment. The sound source device 70 includes a signal converting unit 710, a sound source unit 730, and an output unit 750. A sensor 300 is arranged in correspondence with each key 100 to detect the operation of the key, and output a signal corresponding to the detected content. In this example, the sensor 300 outputs a signal according to a key-pushing amount of three stages. A key-pushing speed can be detected according to an interval of such signals.

The signal converting unit 710 acquires an output signal of the sensor 300 (sensors 300-1, 300-2, . . . , 300-88 corresponding to 88 keys 100), and generates an operation signal corresponding to an operation state in each key 100, and outputs the operation signal. In this example, the operation signal is a signal of MIDI format. The signal converting unit 710 thus outputs a note-on according to the key-pushing operation. A key number indicating which one of the 88 keys 100 is operated, and a velocity corresponding to the key-pushing speed is output in correspondence with the note-on. The signal converting unit 710 corresponds and outputs the key number and a note-off according to a key releasing operation. A signal corresponding to other operations of a pedal, and the like may be input to the signal converting unit 710, and reflected on the operation signal.

The sound source unit 730 generates the sound waveform signal based on the operation signal output from the signal converting unit 710. The output unit 750 outputs the sound waveform signal generated by the sound source unit 730. The sound waveform signal is, for example, output to the speaker 80, a sound waveform signal output terminal, and the like.

[Configuration of Keyboard Assembly]

Figure 3:
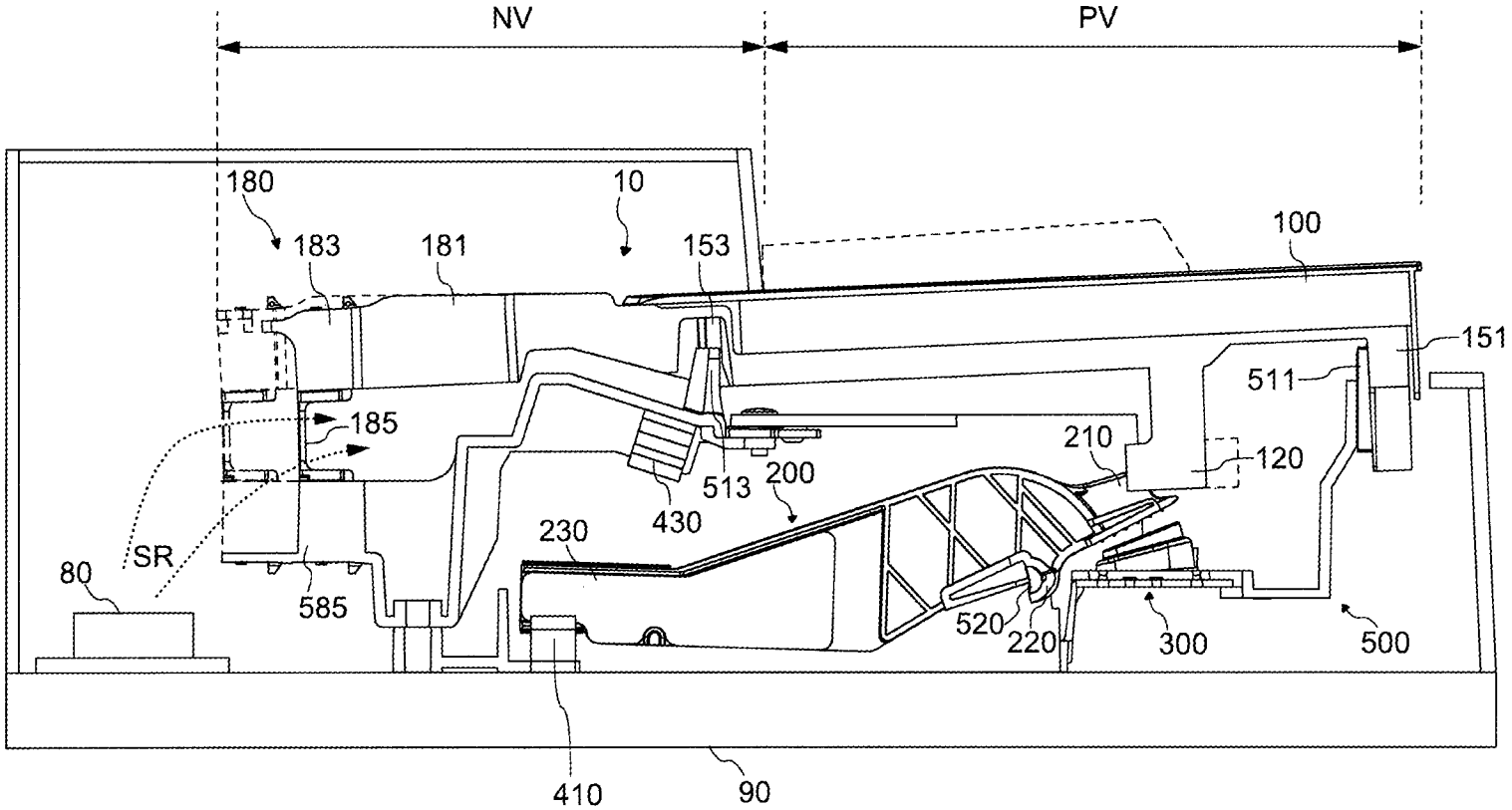
FIG. 3 is an explanatory view of when a configuration inside a housing according to the first embodiment is seen from a side surface.

FIG. 3 is an explanatory view of when the configuration inside the housing according to the first embodiment is seen from a side surface. As shown in FIG. 3, the keyboard assembly 10 and the speaker 80 are arranged inside the housing 90. That is, the housing 90 covers at least a portion of the keyboard assembly 10 (the connecting portion 180 and the frame 500) and the speaker 80. The speaker 80 is arranged on the far side of the keyboard assembly 10. The speaker 80 is arranged to output the sound corresponding to the pushing of the key toward the upper side and the lower side of the housing 90. The sound output toward the lower side advances toward the outside from the lower surface side of the housing 90. The sound output toward the upper side passes from the inside of the housing 90 through a space inside the keyboard assembly 10, and advances toward the outside from the gap between the adjacent keys 100 in the appearing portion PV or the gap between the key 100 and the housing 90. It is to be noted that a route of the sound from the speaker 80 reaching an internal space of the keyboard assembly 10, namely, a space below the key 100 (key main body portion) is exemplified as a route SR.

The configuration of the keyboard assembly 10 will be described using FIG. 3. In addition to the key 100 described above, the keyboard assembly 10 also includes a connecting portion 180, a hammer assembly 200, and a frame 500. The keyboard assembly 10 is a structural body made of resin in which the majority of the configuration is manufactured by injection molding, and the like. The frame 500 is fixed to the housing 90. The connecting portion 180 turnably connects the key 100 to the frame 500. The connecting portion 180 includes a plate-like flexible member 181, a first supporting portion 183, and a rod-like flexible member 185. The connecting portion 180 may include a member that moves integrally with the key 100, or may further include a member that moves integrally with the frame 500. The plate-like flexible member 181 is extended from the back end of the key 100. The first supporting portion 183 is extended from the back end of the plate-like flexible member 181. The rod-like flexible member 185 is supported by the first supporting portion 183 and a second supporting portion 585 of the frame 500. In other words, the plate-like flexible member 181 and the rod-like flexible member 185 serially connected are arranged between the key 100 and the frame 500. In other words, the plate-like flexible member 181 is arranged between the key 100 and the rod-like flexible member 185. Further, the rod-like flexible member 185 is arranged between the plate-like flexible member 181 and the flame 500. The rod-like flexible member 185 arranged in this manner is bent, so that the key 100 can be turned to the frame 500.

The rod-like flexible member 185 is configured to be attachable to and detachable from the first supporting portion 183 and the second supporting portion 585. Thereby, it can also be said that the plate-like flexible member 181 and the rod-like flexible member 185 are configured to be attachable to and detachable from each other by the first supporting member 183. In this example, the plate-like flexible member 181 and the first supporting portion 183 are molded integrally with the key 100 and they are made of the same material. In this example, though the frame 500 is also made of the same material as the plate-like flexible member 181, the frame 500 may at least partially contain a material different from the plate-like flexible member 181.

On the other hand, the rod-like flexible member 185 and the plate-like flexible member 181 contain different materials, and, in this example, the whole of the rod-like flexible member 185 and the whole of the plate-like flexible member 181 are made of materials different from each other. In this example, the plate-like flexible member 181 is harder than the rod-like flexible member 185. That is, the rod-like flexible member 185 is more bendable than the plate-like flexible member 181. As an example of materials having such a relationship, the plate-like flexible member 181 (here, also applying to the key 100 and the frame 500) is made from AS resin and the rod-like flexible member 185 is made from ABS resin or POM resin. By making the rod-like flexible member 185 largely contributing to turning of the key 100 from a soft resin, a touch feeling close to the acoustic piano can be obtained and durability can be obtained, and it is also made easy to obtain a touch feeling having a stiffness feeling by the plate-like flexible member 181 being made from a hard material.

It is to be noted that the plate-like flexible member 181 and the rod-like flexible member 185 may be made from the same material. At this time, when the rod-like flexible member 185 is made from AS resin harder than ABS resin or POM resin in the same manner as the plate-like flexible member 181, it is difficult to obtain a touch feeling close to the acoustic piano. Therefore, it is desirable to adopt a structure where the touch feeling is controlled so as to be close to that of the acoustic piano. On the other hand, when the plate-like flexible member 181 is made from ABS resin or POM resin softer than AS resin like the rod-like flexible member 185, lowering of the stiffness feeling regarding the touch feeling is apt to occur. Therefore, it is desirable to adopt a structure for improving the stiffness feeling.

In this example, the plate-like flexible member 181 and the rod-like flexible member 185 can be separated from each other. Thereby, it also becomes possible to mold the plate-like flexible member 181 and the rod-like flexible member 185 separately, and a degree of freedom when the flexible member is molded can be improved. Therefore, when the plate-like flexible member 181 and the rod-like flexible member 185 are made from the same material, even if the complex structure is required as described above, it becomes easy to adopt a flexible member having a complex structure. It is to be noted that it also becomes to achieve various touch feelings different from that of the acoustic piano because of a high degree of freedom for molding. In this manner, by making the plate-like flexible member 181 and the rod-like flexible member 185 attachable to and detachable from each other, control of the touch feeling can be performed easily. Accordingly, the degree of freedom for design of a touch feeling is improved.

The key 100 includes a front end key guide 151 and a side key guide 153. The front end key guide 151 is slidably brought into contact with a front end frame guide 511 of the frame 500 while covering the front end frame guide 511. The front end key guide 151 is brought into contact with the front end frame guide 511 from both sides in the scale direction, the upper part and the lower part. In the front end key guide 151, the upper part corresponds to an upper key guide 151*u*, and the lower part corresponds to a lower key guide 151*d* (see FIGS. 7A to 7D). The side key guide 153 is slidably brought into contact with a side frame guide 513 from both sides in the scale direction. In this example, the side key guide 153 is arranged in a region corresponding to the non-appearing portion NV of the side surface of the key 100, and exists on the key front end side from the connecting portion 180 (plate-like flexible member 181), but may be arranged in a region corresponding to the appearing portion PV.

The hammer assembly 200 is arranged in a space below the key 100 and it is attached to the frame 500 in a turnable manner thereto. A shaft supporting portion 220 of the hammer assembly 200 and a shaft 520 of the frame 500 are slidably brought into contact at at least three points. A front end 210 of the hammer assembly 200 is brought into contact with a hammer supporting portion 120 in an internal space of the hammer supporting portion 120 in a manner slidable in essentially a front and back direction. The slidably moving portion, that is, the portion where the front end 210 and the hammer supporting portion 120 are brought into contact is located on the lower side of the key 100 in the appearing portion PV (front side from the back end of the key main body portion).

The hammer assembly 200 includes a weight portion 230 made of metal at a far side from the shaft. At a normal time (when key is not pushed), the weight portion 230 is mounted on a lower stopper 410, and the front end 210 of the hammer assembly 200 is pushing back the key 100. When the key is pushed, the weight portion 230 is moved upward thus hitting an upper stopper 430. The hammer assembly 200 applies a load to the pushing of the key with the weight portion 230. The lower stopper 410 and the upper stopper 430 are formed with a buffer material and the like (non-woven cloth, elastic body, etc.).

The sensor 300 is attached to the frame 500 on the lower side of the hammer supporting portion 120 and the front end 210. The front end 210 deforms the sensor 300 with the lower surface side thereof according to the pushing of the key, and the sensor 300 outputs a detection signal. As described above, the sensor 300 is arranged in correspondence with each key 100.

Figure 4:
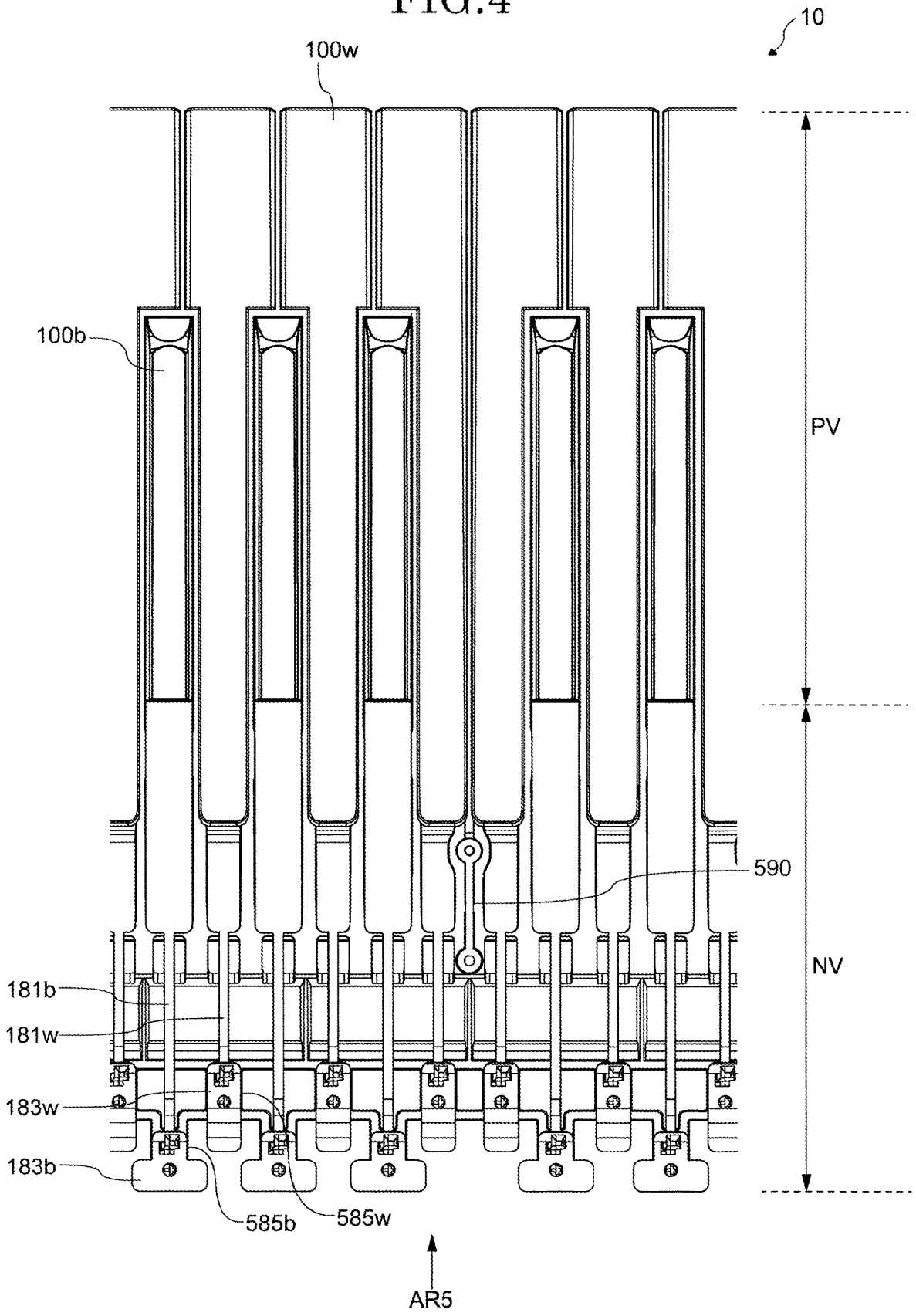
FIG. 4 is an explanatory view of when a keyboard assembly according to the first embodiment is seen from an upper surface.
Figure 5:
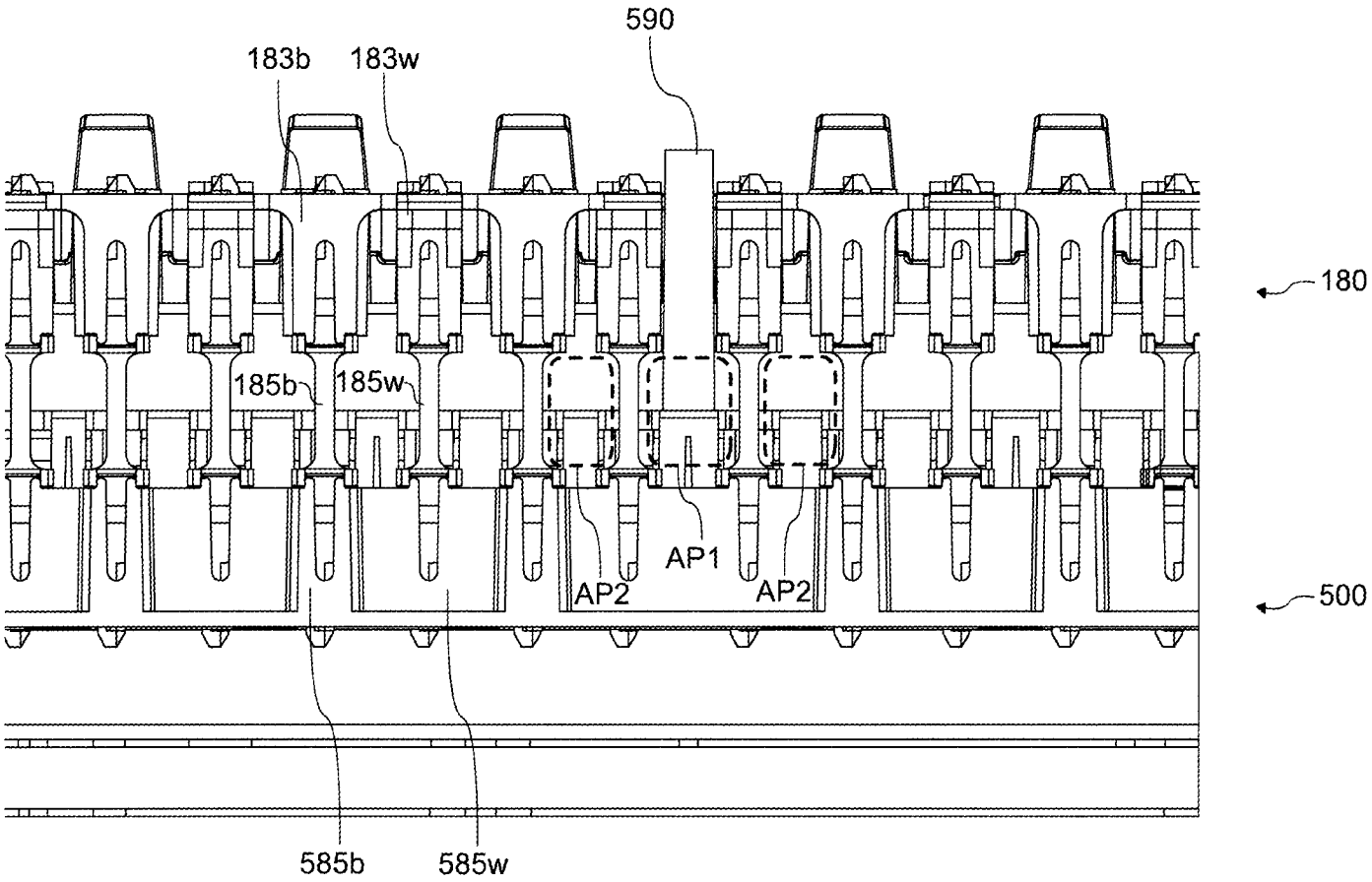
FIG. 5 is an explanatory view of when a frame according to the first embodiment is seen from a far side.
Figure 6:
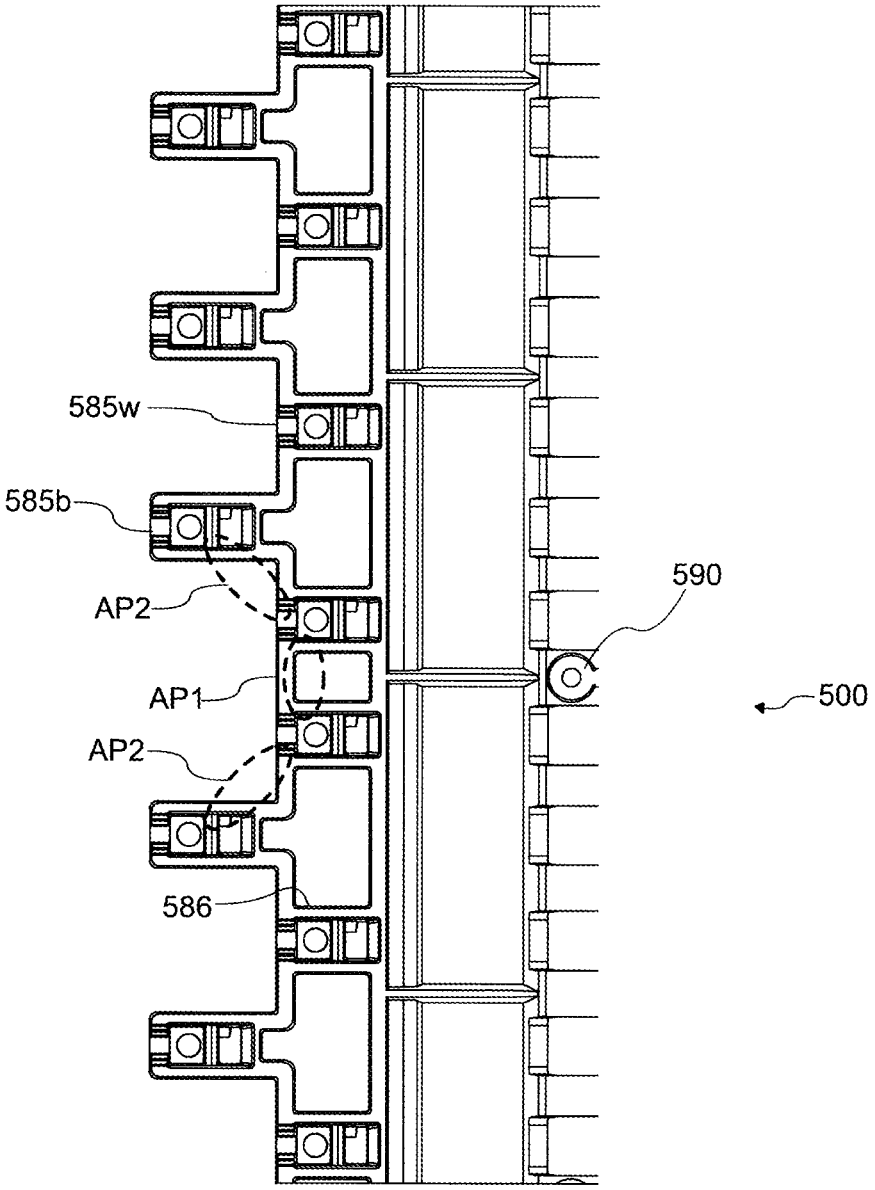
FIG. 6 is an explanatory view of when a portion of the frame where a rod-like flexible member is connected according to the first embodiment is seen from the upper surface.

FIG. 4 is an explanatory view of when the keyboard assembly according to the first embodiment is seen from the upper surface. FIG. 5 is an explanatory view of when the frame according to the first embodiment is seen from the far side (AR5 direction indicated in FIG. 4). FIG. 6 is an explanatory view of when a portion of the frame where the rod-like flexible member is connected according to the first embodiment is seen from the upper surface. In these figures, the illustration of one part of the configurations of the hammer assembly 200 and the frame 500 located on the lower side of the key 100 is omitted. Specifically, the configuration (second supporting portion 585, etc.) of the frame 500 in the vicinity of the connecting portion 180 is illustrated, and the illustration of one part of the configuration on the near side, and the like is omitted. In other descriptions as well, the illustration of one part is sometimes omitted.

As shown in FIG. 4, a first supporting portion 183*b* is arranged on the far side from a first supporting portion 183*w*. This position is associated with the position of the rod-like flexible member 185 that becomes the turning center of the key 100. The difference in the turning center of the white key and the black key of an acoustic piano can be demonstrated by such arrangement. In this example, a plate-like flexible member 181*b* corresponding to the black key is longer than a plate-like flexible member 181*w* corresponding to the white key. In correspondence with such arrangement, a second supporting portion 585*b* of the frame 500 is arranged on the far side from a second supporting portion 585*w*. Thus, the shape of the far side (second supporting portion 585) of the frame 500 is a shape in which the second supporting portion 585*b* is projected out from the second supporting portion 585*w*, as shown in FIG. 6.

As shown in FIG. 5, a large space exists between the rod-like flexible members 185*b*, 185*w*. The sound output from the speaker 80 is passed through such space from outside of the keyboard assembly 10 to reach the inside, and released to the outside of the keyboard apparatus 1 from the gap between the adjacent keys 100. As there is only a few elements that shield the passing of the sound between the frame 500 (second supporting portion 585) and the connecting portion 180 (first supporting portion 183) due to the existence of the rod-like flexible member 185 in path until the sound is released to the outside from the appearing portion PV, the attenuation amount of the sound can be suppressed. That is, acoustic passages AP1 and AP2 are arranged between the rod-like flexible members 185 adjacent to each other. Further, as shown in FIG. 6, since the second supporting portion 585*b* has a shape protruding beyond the second supporting portion 585*w*, the acoustic passage AP2 at a portion to which the second supporting portions 585*w* and the 585*b* are adjacent is wider than the acoustic passage AP1 at a portion to which the second supporting portion 585*w* is adjacent. Further, as shown in FIG. 6, an opening portion 586 may be arranged in the scale direction of the second supporting portion 585*w* on a near side of the second supporting portion 585*b*. In this case, the opening portion 586 can also form an acoustic passage.

A supporting column 590 is a member connected to the housing 90 to fix the position of the frame 500 with respect to the housing 90. The supporting column 590 is arranged between portions where the white keys 100*w* are adjacent in the non-appearing portion NV, that is, between the white key 100*w* of "E" and the white key 100*w* of "F", and between the white key 100*w* of "B" and the white key 100*w* of "C".

[Structure of White Key]

Figure 7A:
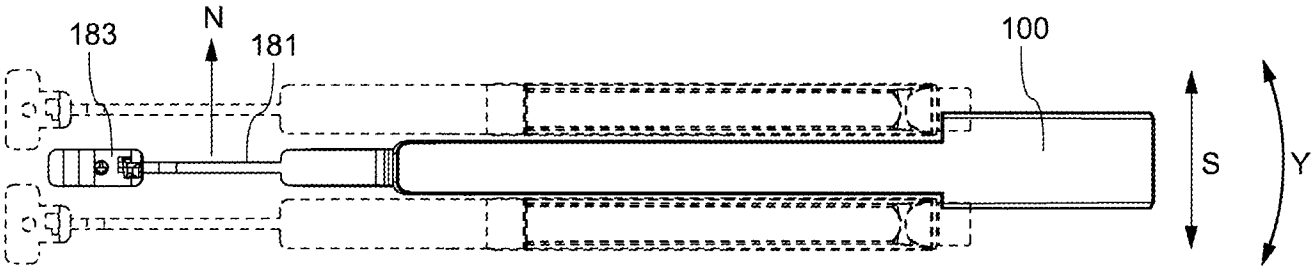
FIG. 7A is a view describing a detailed structure of a white key according to the first embodiment and a view of when the white key is seen from an upper surface.
Figure 7B:
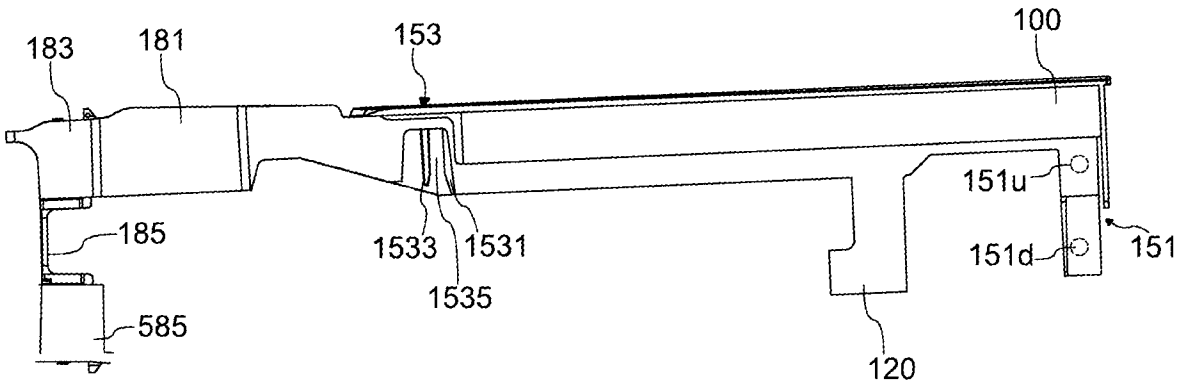
FIG. 7B is a view describing the detailed structure of the white key according to the first embodiment and a view of when the white key is seen from a side surface (left side).
Figure 7C:
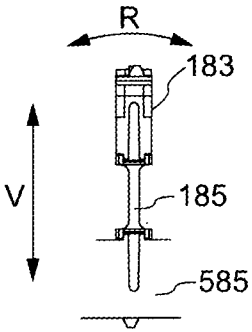
FIG. 7C is a view describing the detailed structure of the white key according to the first embodiment and a view of when the connecting portion is seen from a far side.
Figure 7D:
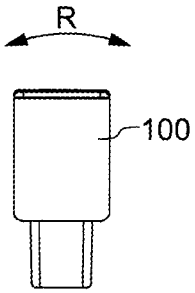
FIG. 7D is a view describing the detailed structure of the white key according to the first embodiment and a view of when the white key is seen from a near side.

FIGS. 7A to 7D are views describing a detailed structure of a white key in the first embodiment. FIG. 7A is a view of the white key 100*w* seen from the upper surface. FIG. 7B is a view of the white key 100*w* seen from the side surface (left side). FIG. 7C is a view of the connecting portion 180 seen from the far side. FIG. 7D is a view of the white key 100*w* seen from the near side.

First, directions (scale direction S, rolling direction R, yawing direction Y, vertical direction V) used in the following description will be defined. The scale direction S corresponds to a direction (left and right direction seen from the player) in which the keys 100 are arrayed, as described above. The rolling direction R corresponds to a direction of rotating with an extending direction (direction from near side to far side seen from the player) of the key 100 as an axis. The yawing direction Y is a direction of bending in the left and right direction when the key 100 is seen from above. There is no great difference between the scale direction S and the yawing direction Y, but the movement in the scale direction S of the key 100 is a parallel movement whereas the movement in the yawing direction Y of the key 100 corresponds to bending (warping) in the scale direction S. The vertical direction V corresponds to a direction (vertical direction seen from the player) in which the rod-like flexible member 185 is extended, and can also be referred to as a direction that becomes an axis of bending in the yawing direction Y.

The key 100 includes the front end key guide 151 and the side key guide 153. As described above, the front end key guide 151 is brought into contact with the front end frame guide 511 of the frame 500 at the upper part and the lower part. Thus, the front end key guide 151 is actually divided into the upper key guide 151*u* and the lower key guide 151*d*. The front end key guide 151 (upper key guide 151*u*, lower key guide 151*d*) and the side key guide 153 regulate the movement of the key 100 at three locations not lined in a straight line when the key 100 is seen in the scale direction S. The movement of the key 100 is regulated in the scale direction S, the yawing direction Y, and the rolling direction R according to the guide at least three locations arranged in such manner. In this example, the side key guide 153 also regulates the movement in the front and back direction of the key 100 as the side frame guide slidably moves on a groove 1535 formed by projections 1531, 1533. The number of guides may be three or more locations. In this case, not all guides need to satisfy a requirement of not being lined in a straight line, and the guide at at least three locations merely needs to satisfy the requirement.

The plate-like flexible member 181 is a plate-like member having flexibility in the scale direction S. The plate-like flexible member 181 is arranged so that a normal direction N of a plate surface is directed in the scale direction S. Thus, the plate-like flexible member 181 can be deformed in the rolling direction R and the yawing direction Y by being bent and twisted. In other words, the plate-like flexible member 181 has a degree of freedom in the rolling direction R and the yawing direction Y of the key 100 due to its flexibility. It can also be said that by combining deformations in the yawing direction Y at a plurality of portions (a state having a plurality of inflection points), the plate-like flexible member 181 also has a degree of freedom in the scale direction S. However, the plate-like flexible member 181 barely deforms in the vertical direction. The normal direction N may not completely coincide with the scale direction S. and merely needs to have a component in the scale direction S. If the normal direction does not coincide with the scale direction, an angle formed by the normal direction N and the scale direction S is preferably as small as possible.

The rod-like flexible member 185 is a rod-like member having flexibility in the scale direction S (meaning being capable of bending along the scale direction S) and flexibility in an in-plane (meaning being capable of bending in the in-plane) having a normal line extending in the scale direction S (the pitch direction: a turning direction in the pushing of the key). The rod-like flexible member 185 can be deformed in the rolling direction R and the yawing direction Y by being bent and twisted. In other words, the rod-like flexible member 185 has a degree of freedom in the rolling direction R and the yawing direction Y of the key 100 due to its flexibility. It can also be said that by combining deformations in the rolling direction R at a plurality of portions (a state having a plurality of inflection points), the rod-like flexible member 185 also has a degree of freedom in the scale direction S. However, the rod-like flexible member 185 barely deforms in the vertical direction. The rod-like flexible member 185 has more twistable amount than the plate-like flexible member 181 due its shape property.

Thus, the connecting portion 180 not only turns the key 100 in a pitch direction with respect to the frame 500 so that a vertical displacement barely occurs (vertical movement of turning center barely occurs) with respect to a strong force of pushing of the key at a back side of the key (far side) from the side key guide 153, but also allows deformation with respect to the rolling direction R and the yawing direction Y. In other words, the connecting portion 180 not only turns the key 100 with respect to the frame 500, but allows deformation with respect to the rolling direction R and the yawing direction Y. The connecting portion 180 has the movement regulated in the vertical direction, but has a degree of freedom with respect to the rolling direction R and the yawing direction Y of the key 100. As described above, it can also be said that by combining deformations in the rolling direction R at a plurality of portions (a state having a plurality of inflection points), the connecting portion 180 also has a degree of freedom in the scale direction S.

As described above, the key 100 sometimes produces deformation including the yawing direction Y and rolling direction R due to manufacturing error and temporal change. In this case, the influence of deformation of the key 100 is prevented from being visibly recognized as much as possible in the appearing portion PV between the front end key guide 151 and the side key guide 153 by the regulation of such guides. As the influence of deformation is suppressed at the appearing portion PV, the non-appearing portion NV is greatly subjected to such influence of deformation. The influence is more significant the longer the key 100.

For example, assume a case in which a deformation (deformation in the rolling direction R) where the key 100 is gradually twisted occurred as a first example. In this case, the direction of the rolling direction R of the front end portion of the key 100 is regulated so as to be in a perpendicular direction by the upper key guide 151*u* and the lower key guide 151*d*, and thus the influence of deformation in the rolling direction R becomes greater toward the far side in the key 100. As a second example, assume a case in which a deformation (deformation in the yawing direction Y) where the key 100 is gradually bent in the scale direction S occurred. In this case, the position in the scale direction S of the key 100 in the appearing portion PV is regulated by the front end key guide 151 and the side key guide 153, and thus the influence of deformation in the yawing direction Y becomes greater toward the far side in the key 100.

In either case, the positions of the portion that becomes the turning center of the key 100 and the frame 500 start to shift by the influence of deformation of the key 100. In other words, a positional relationship between the connecting portion 180 connected to the key 100 and the second supporting portion 585 varies.

On the other hand, by adopting the key 100 according to the first embodiment, the plate-like flexible member 181 and the rod-like flexible member 185 can deform owing to the flexibilities thereof. That is, even if positional deviation occurs between the key 100 and the second supporting portion 585, the connecting portion 180 (the plate-like flexible member 181 and the rod-like flexible member 185) can connect the key 100 and the second supporting portion 585 to each other by its own deformation. At this time, the rod-like flexible member 185 has the following two functions simultaneously. First, the rod-like flexible member 185 has a function as a member turning the key 100 in the pitch direction because the rod-like flexible member 185 allows bending deformation of the key 100 in the front and back directions while hardly causing the displacement in the vertical direction against a strong force such as a key-pushing force (movement of the turning center in the vertical direction hardly occurs). Secondly, the rod-like flexible member 185 also has a function as a member for absorbing influence occurring from the deformation of the key 100 by its own deformation.

As described above, the influence of deformation of the key 100 is suppressed as much as possible from being visibly recognized at the appearing portion PV, and thus the positional precision in the scale direction S is also high. Thus, the front end 210 of the hammer assembly 200 detected by the sensor 300 and the hammer supporting portion 120 of the key 100 connected to the front end 210 are desirably arranged on the lower side of the key 100 of the appearing portion PV (front side from the back end of the key main body portion).

[Structure of Rod-Like Flexible Member]

In this example, the rod-like flexible member 185 is detachable from the first supporting portion 183 and the second supporting portion 585. The configuration of the rod-like flexible member 185 will be described.

Figure 8A:
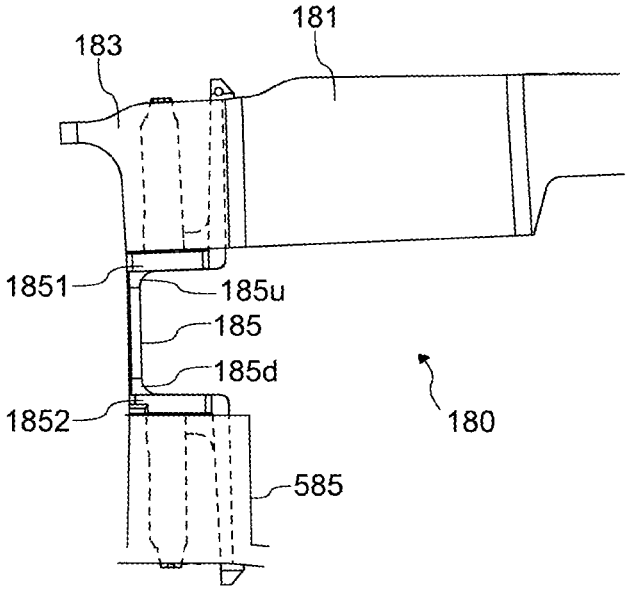
FIG. 8A is a view describing a structure of the rod-like flexible member according to the first embodiment and an enlarged view showing a neighborhood of a connecting portion in FIG. 7B.
Figure 8B:
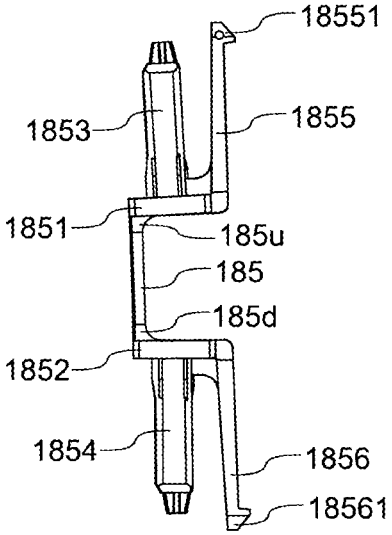
FIG. 8B is a view describing the structure of the rod-like flexible member according to the first embodiment and a view showing a state where the rod-like flexible member has been removed.
Figure 8C:
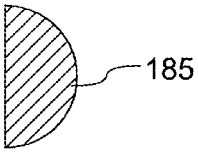
FIG. 8C is a view describing the structure of the rod-like flexible member according to the first embodiment and a view describing a cross-sectional shape of the rod-like flexible member.

FIGS. 8A to 8C are views describing the structure of the rod-like flexible member according to the first embodiment. FIG. 8A is an enlarged view of a neighborhood of the connecting portion 180 in FIG. 7B. FIG. 8B is a view showing a state where the rod-like flexible member 185 has been removed. FIG. 8C is a view describing a cross-sectional shape of the rod-like flexible member 185.

The rod-like flexible member 185 is connected to pedestals 1851 and 1852 at both ends thereof. The rod-like flexible member 185 includes regions 185*u* and 185*d* where a thickness of a rod is increased according to coming close to the pedestals at portions connected to the pedestals 1851 and 1852. It is to be noted that the rod-like flexible member 185 does not include regions where the thickness is increased. That is, the regions 185*u* and 185*d* may not exist.

The pedestal 1851 is provided with a supporting rod 1853 and an engaging rod 1855 on a face opposite to a face on which the rod-like flexible member 185 is arranged. The supporting rod 1853 is inserted into a hole formed in the first supporting portion 183 from below. The engaging rod 1855 has a top portion on which an engaging portion 18551 is arranged. The engaging rod 1855 is inserted into a hole formed in the first supporting portion 183 from below. The engaging portion 18551 is caught on an upper surface of the first supporting portion 183, so that the engaging rod 1855 is prevented from coming out of the first supporting portion 183 due to turning of the key 100. The engaging rod 1855 has flexibility. By bending the engaging rod 1855 to move the same toward the supporting rod 1853, engagement of the engaging rod 1855 with the first supporting portion 183 is released. Specific attaching and detaching methods will be described later.

The pedestal 1852 is provided with a supporting rod 1854 and an engaging rod 1856 on a face opposite to a face where the rod-like supporting member 185 is arranged. The supporting rod 1854 is inserted into a hole formed in the second supporting portion 585 from above. The engaging rod 1856 has a top portion where an engaging portion 18561 is arranged. The engaging rod 1856 is inserted into a hole formed in the second supporting portion 585 from above. The engaging portion 18561 is caught on a lower surface of the second supporting portion 585, so that the engaging rod 1856 is prevented from coming out of the second supporting rod 585 due to turning of the key 100. The engaging rod 1856 has flexibility. Engagement to the second supporting portion 585 performed by the engaging rod 1856 is released by deforming the engaging rod 1856 toward the supporting rod 1854. By bending the engaging rod 1856 to move the same toward the supporting rod 1854, engagement of the engaging rod 1856 with the second supporting portion 585 is released. Specific attaching and detaching methods will be described later.

In this manner, the rod-like flexible member 185 is supported by the first supporting member 183 and the second supporting member 585, so that when the key 100 is at a rest position (when the rod-like flexible member 185 is not deformed), a longitudinal direction (vertical direction V) of the rod-like flexible member 185 is approximately perpendicular to a surface of the key 100 (key main body portion). Thereby, the rod-like flexible member 185 is strengthened regarding a load to the vertical direction V. Further, at this time, the longitudinal direction (vertical direction V) of the rod-like flexible member 185 may be approximately perpendicular to a normal direction N of the plate-like flexible member 181.

FIG. 8C is a view describing a cross-sectional shape of the rod-like flexible member 185. Specifically, FIG. 8C is a view of when the rod-like flexible member 185 has been cut to the longitudinal direction (an extending direction, the vertical direction V in this example) of the rod-like flexible member 185 by a vertical face. The cross-sectional shape of the rod-like flexible member 185 has a shape surrounded by a combination of straight lines and curved lines, and in this example, is semicircular. In the semicircular shape, a straight line portion is positioned on a far side, and a curved line portion is positioned on a near side, but these line portions may be reverse. The cross-sectional shape of the rod-like flexible member 185 may has a shape surrounded by only curved lines (e.g., a circular shape) or a shape surrounded by only straight lines (a rectangular shape). Further, an area of this shape may vary depending on a portion of the shape in the longitudinal direction. For example, the area may have the smallest area at a center portion of the shape in the longitudinal direction. That is, as long as the rod-like flexible member 185 can be bent deformed in directions (two directions of three directions defining three dimensions) other than the vertical direction V, and twisting deformation with the vertical direction V as an axis is possible, the cross-sectional shape may have any shape. The rod-like flexible member 185 may have a shape in which a thickness changes along the longitudinal direction such as a cone shape. Furthermore, when an outer edge of the cross-sectional shape of the rod-like flexible member 185 is accommodated in a rectangle, a ratio of a length of two orthogonal sides of the rectangle is desirably greater than or equal to 3/4 and smaller than or equal to 4/3.

[Attaching and Detaching Methods of Rod-Like Flexible Member]

Subsequently, a method for detaching the rod-like flexible member 185 from the first supporting portion 183 and the second supporting portion 585.

Figure 9A:
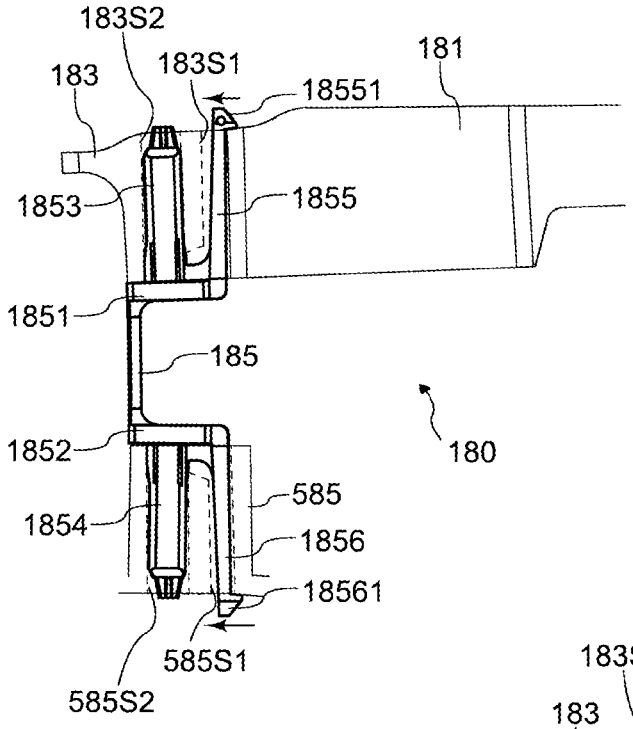
FIG. 9A is a view for describing a method for detaching the rod-like flexible member in the first embodiment from the other members, a view corresponding to FIG. 8A, and showing a configuration present inside of the first supporting portion and the second supporting portion in an easily visible manner.
Figure 9B:
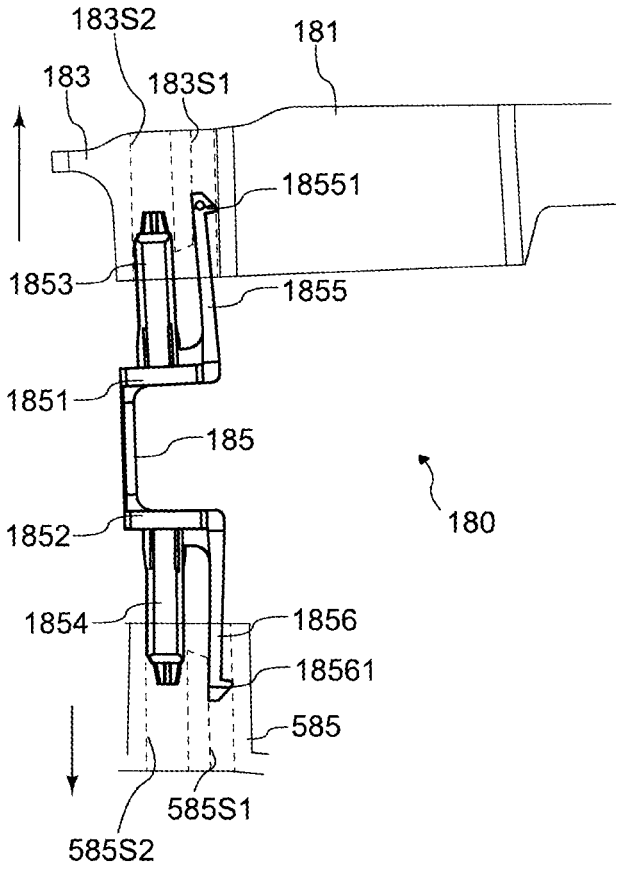
FIG. 9B is a view for describing a method for detaching the rod-like flexible member in the first embodiment from the other members and a view for describing a stage in the middle of detaching the rod-like flexible member from the first supporting portion and the second supporting portion.

FIGS. 9A and 9B are views for describing a method for detaching the rod-like flexible member in the first embodiment from the other members. FIG. 9A is a view corresponding to FIG. 8A and showing a configuration present inside of the first supporting portion 183 and the second supporting portion 585 in an easily visible manner. FIG. 9B is a view for describing a stage in the middle of detaching the rod-like flexible member 185 from the first supporting portion 183 and the second supporting portion 585. It is to be noted that a view of a case where the rod-like flexible member 185 has been completely detached is shown in FIG. 8B.

A first space 183S1 and a second space 183S2 extending through in the vertical direction are formed inside of the first supporting portion 183. The engaging rod 1855 is inserted into the first space 183S1. The engaging portion 18551 is protruded from the first space 183S1 upwardly. The supporting rod 1853 is inserted into the second space 183S2. A first space 585S1 and a second space 585S2 extending through in the vertical direction are formed inside the second supporting portion 585. The engaging rod 1856 is inserted into the first space 585S1. The engaging portion 18561 is protruded from the first space 585S1 downwardly. The supporting rod 1854 is inserted into the second space 585S2.

First of all, a method for detaching the rod-like flexible member 185 from the first supporting portion 183 will be described. When a force is applied to the engaging portion 18551 toward the supporting rod 1853, the engaging rod 1855 having flexibility is bent, so that the engaging portion 18551 is moved up to a position where the engaging portion 18551 can pass through the inside of the first space 183S1. Then, when the first supporting portion 183 is moved upwardly to the rod-like flexible member 185, as shown in FIG. 9B, the engaging portion 18551 passes through the inside of the first space 183S1. When the first supporting portion 183 is further moved upwardly, the first supporting portion 183 and the rod-like flexible member 185 are separated from each other, so that the shape of the engaging rod 1855 is returned to an original shape of the engaging rod 1855 (FIG. 8B).

On the other hand, when the rod-like flexible member 185 is attached to the first supporting portion 183, the supporting rod 1853 is inserted into the second space 18352 from below, and the first supporting portion 183 is moved downwardly while the engaging portion 18551 is being inserted into the first space 183S1 from below. At this time, a distal end shape of the engaging portion 18551 has a slope, so that, while the engaging rod 1855 is being bent toward the supporting rod 1853, the engaging portion 18551 and the engaging rod 1855 are inserted into the first space 183S1 (FIG. 9B). When the first supporting portion 183 is further moved downwardly, the engaging portion 18551 is protruded from the first space 183S1 upwardly and the shape of the engaging rod 1855 is returned to the original shape, so that the engaging portion 18551 is engaged with an upper face of the first supporting portion 183. Thus, it can also be said that the first supporting portion 183 and the engaging rod 1855 constitute a connector for connecting the plate-like flexible member 181 and the rod-like flexible member 185 to each other attachably and detachably.

Then, a method for detaching the rod-like flexible member 185 from the second supporting portion 585 will be described. The detaching method is basically similar to the case of detaching the rod-like flexible member 185 from the first supporting portion 183. When a force is applied to the engaging portion 18561 toward the supporting rod 1854, the engaging rod 1856 having flexibility is bent, so that the engaging portion 18561 is moved up to a position where the engaging portion 18561 can pass through the inside of the first space 585S1. Then, when the second supporting portion 585 is moved to the rod-like flexible member 185 upwardly, as shown in FIG. 9B, the engaging portion 18561 passes through the inside of the first space 585S1. When the second supporting portion 585 is further moved downwardly (when the rod-like flexible member 185 is moved upwardly), the second supporting portion 585 and the rod-like flexible member 185 are separated from each other, so that the shape of the engaging rod 1856 is returned to an original shape of the engaging rod 1856 (FIG. 8B).

On the other hand, when the rod-like flexible member 185 is attached to the second supporting portion 585, the supporting rod 1854 is inserted into the second space 585S2 from above and, while the engaging portion 18561 is being inserted into the first space 585S1 from above, the second supporting portion 585 is moved upwardly (the rod-like flexible member 185 is moved downwardly). At this time, a distal end shape of the engaging portion 18561 has a slope, so that, while the engaging rod 1856 is being bent toward the supporting rod 1854, the engaging portion 18561 and the engaging rod 1856 are inserted into the first space 585S1 (FIG. 9B). When the second supporting portion 585 is further moved upwardly (when the rod-like flexible member 185 is moved downwardly), the engaging portion 18561 is protruded from the first space 585S1 downwardly, and the shape of the engaging rod 1856 is returned to the original shape, so that the engaging portion 18561 is engaged with a lower face of the second supporting portion 585. Thus, it can also be said that the second supporting portion 585 and the engaging rod 1856 constitute a connector for connecting the frame 500 and the rod-like flexible member 185 to each other attachably and detachably.

It is to be noted that FIG. 9B shows a stage in the middle of detaching the rod-like flexible member 185 from both of the first supporting portion 183 and the second supporting portion 585, but it is unnecessary to detach both of the first supporting portion 183 and the second supporting portion 585 simultaneously. Further, the rod-like flexible member 185 may be detached from one of the first supporting portion 183 and the second supporting portion 585, then may be detached from the other.

When the rod-like flexible member 185 is attached to the first supporting portion 183 and the second supporting portion 585, a pressure is applied to the rod-like supporting member 185 in the vertical direction. As described above, the rod-like flexible member 185 has a strong resistance to a load acting in the vertical direction due to the shape thereof, so that deformation of the rod-like flexible member 185 in the vertical direction can be suppressed in an attaching work, and the work can also be performed easily.

[Comparison of White Key and Black Key]

Figure 10A:
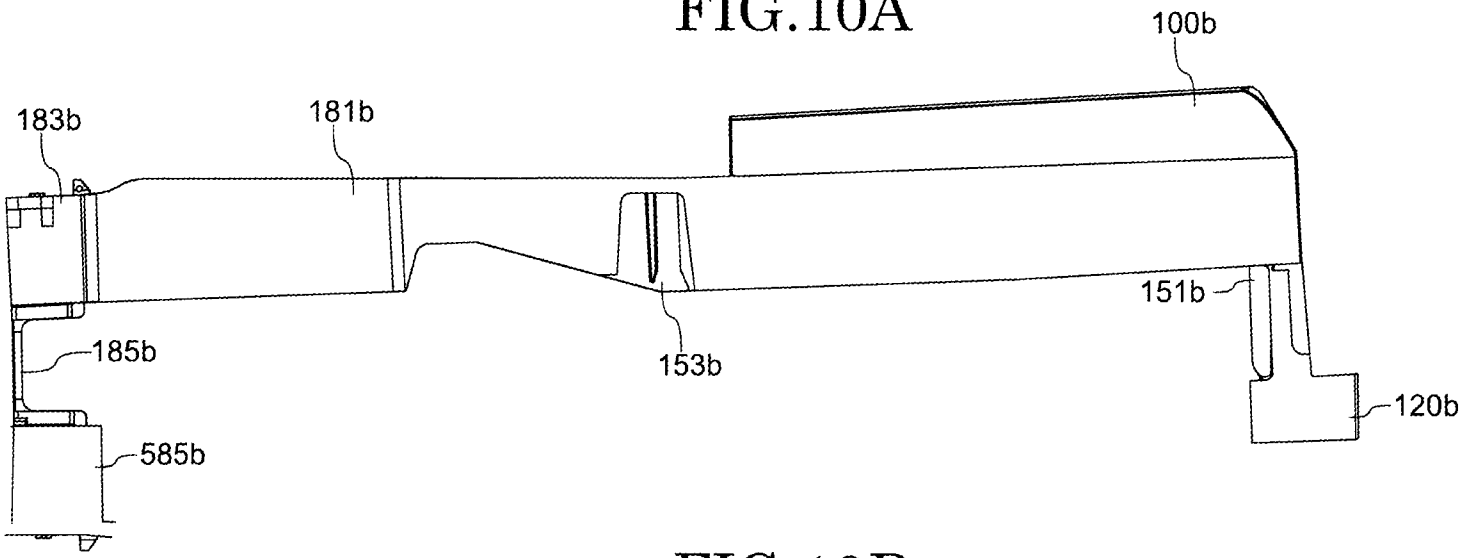
FIG. 10A is a view describing a structure of a black key according to the first embodiment in comparison with the structure of the white key and a view showing the black key.
Figure 10B:
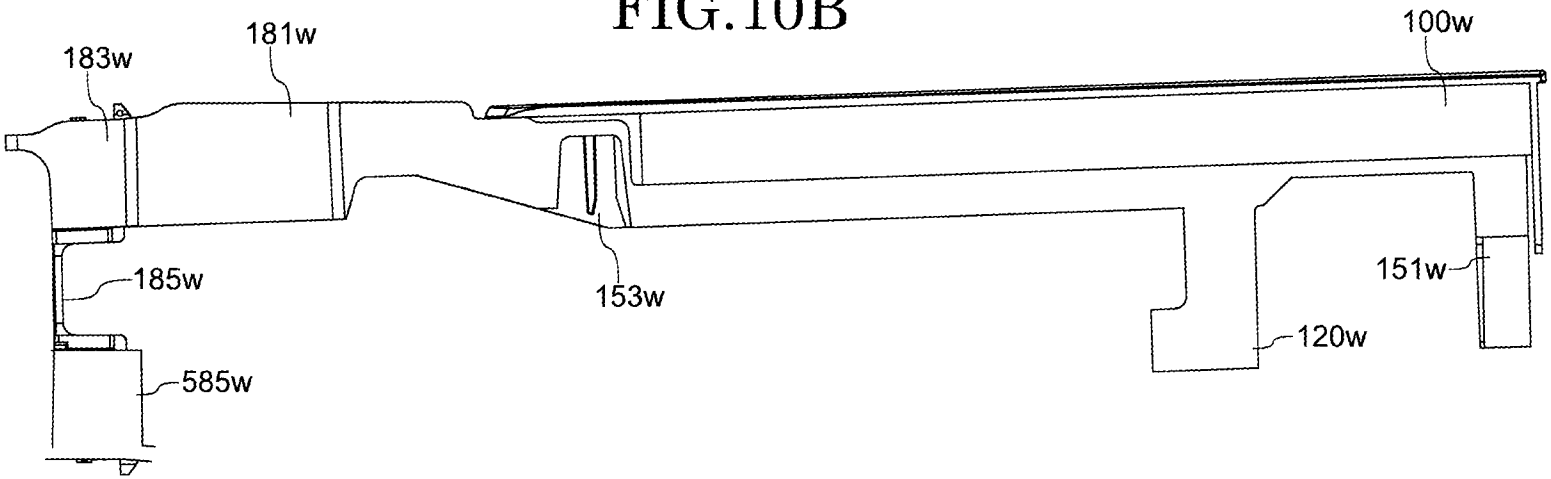
FIG. 10B is a view describing the structure of the black key according to the first embodiment in comparison with the structure of the white key and a view showing the white key.

FIGS. 10A and 10B are views describing a structure of a black key in the first embodiment in comparison with the structure of the white key. FIG. 10A shows a black key. FIG. 10B shows a white key. In FIGS. 10A and 10B, the positions in the front and back direction of the white key 100*w* and the black key 100*b* are shown in an associated manner. The white key 100*w* and the black key 100*b* differ in the following points. The plate-like flexible member 181*b* is longer than the plate-like flexible member 181*w*. In this example, the positions of the turning center of the key are differed by such difference, but the positions of the turning center of the key may be differed through other methods. For example, the plate-like flexible member 181*b* and the plate-like flexible member 181*w* may have the same length, and the length other than the plate-like flexible member 181*b* of the black key 100*b* may be lengthened. At this time, since the rod-like flexible member 185*b* and the first supporting portion 183*b* can be separated from each other, a common rod-like flexible member 185*b* can be used for a different type of a black key 100*b*.

In the white key 100*w*, the front end key guide 151*w* is arranged at a different location with respect to the key front and back direction from the hammer supporting portion 120*w*. In the black key 100*b*, on the other hand, the front end key guide 151*b* and the hammer supporting portion 120*b* are arranged at substantially the same location in the key front and back direction. In other words, in the black key 100*b*, the hammer supporting portion 120*b* is arranged at a front end portion of the black key 100*b*. That is, the hammer supporting portion 120*w* of the white key 100*w* is arranged in accordance with the position of the hammer supporting portion 120*b* of the black key 100*b*.

[Operation of Keyboard Assembly]

Figure 11A:
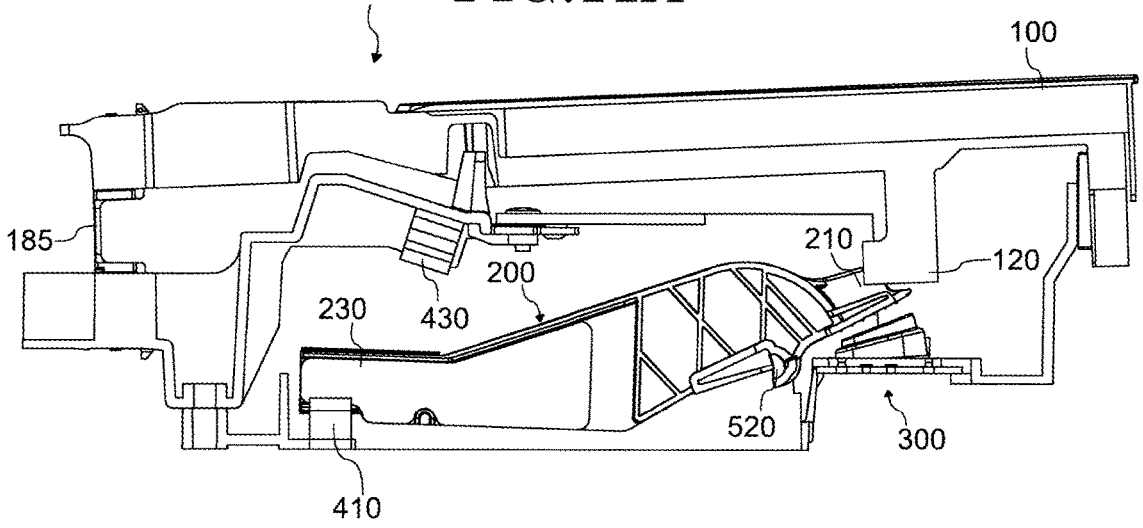
FIG. 11A is a view describing an operation of a key assembly of when the key (white key) according to the first embodiment is pushed and a view of a case where the key is at a rest position (a state where the key is not pushed).
Figure 11B:
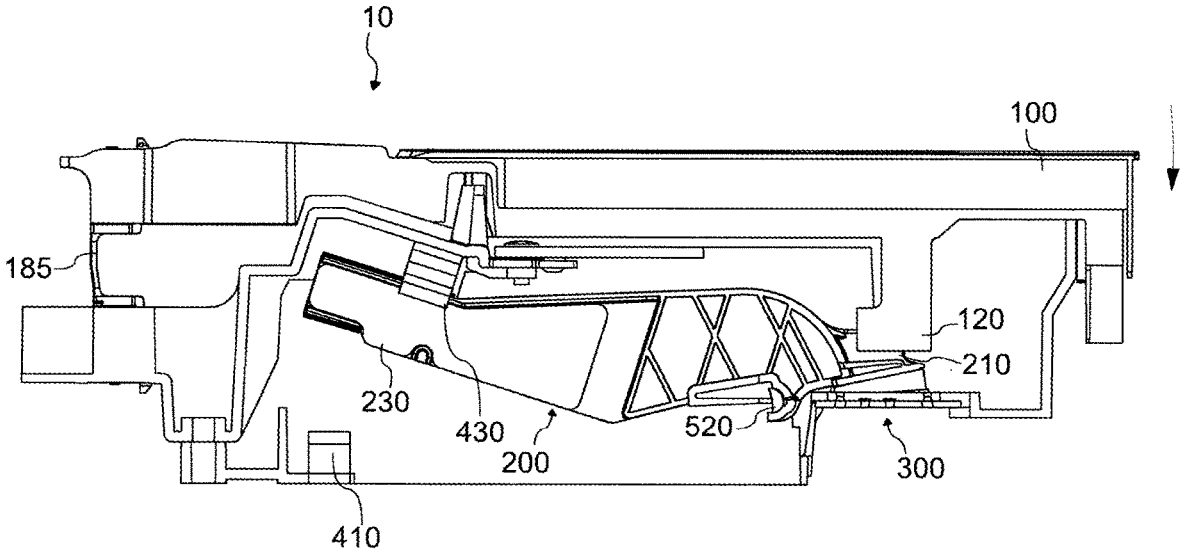
FIG. 11B is a view describing the operation of the key assembly of when the key (white key) according to the first embodiment is pushed and a view of a case where the key is at an end position (a state where the key is pushed up to the end).

FIGS. 11A and 11B are views describing an operation of the key assembly of when the key (white key) is pushed in the first embodiment. FIG. 11A is a view of when the key 100 is at a rest position (a state where the key is not pushed). FIG. 11B is a view of when the key 100 is at an end position (a state where the key is pushed to the end). When the key 100 is pushed, the key is bent with the rod-like flexible member 185 as the turning center. In this case, the rod-like flexible member 185 is bent deformed toward the front side (near side direction) of the key, but the key 100 is turned in the pitch direction rather than being moved forward by the regulation of the movement in the front and back direction by the side key guide 153. As the hammer supporting portion 120 pushes down the front end 210, the hammer assembly 200 turns with the shaft 520 as the center. The turning of the hammer assembly 200 stops when the weight portion 230 hits the upper stopper 430, whereby the key 100 reaches the end position. Furthermore, when the sensor 300 is deformed by the front end 210, the sensor 300 outputs a detection signal at a plurality of stages corresponding to the deformed amount (key pushing amount).

When the key is released, the weight portion 230 is moved toward the lower side, the hammer assembly 200 is turned, and the key 100 is turned toward the upper side. The turning of the hammer assembly 200 is stopped when the weight portion 230 is brought into contact with the lower stopper 410, and the key 100 is returned to the rest position.

Second Embodiment

In a second embodiment, a keyboard assembly 10A provided with a connecting portion 180A having a configuration different from that of the connecting portion 180 in the first embodiment will be described. Here, as an example, the connecting portion 180A having a configuration where a plate-like flexible member 181A is closer to a frame 500A than a rod-like flexible member 185A will be described.

Figure 12A:
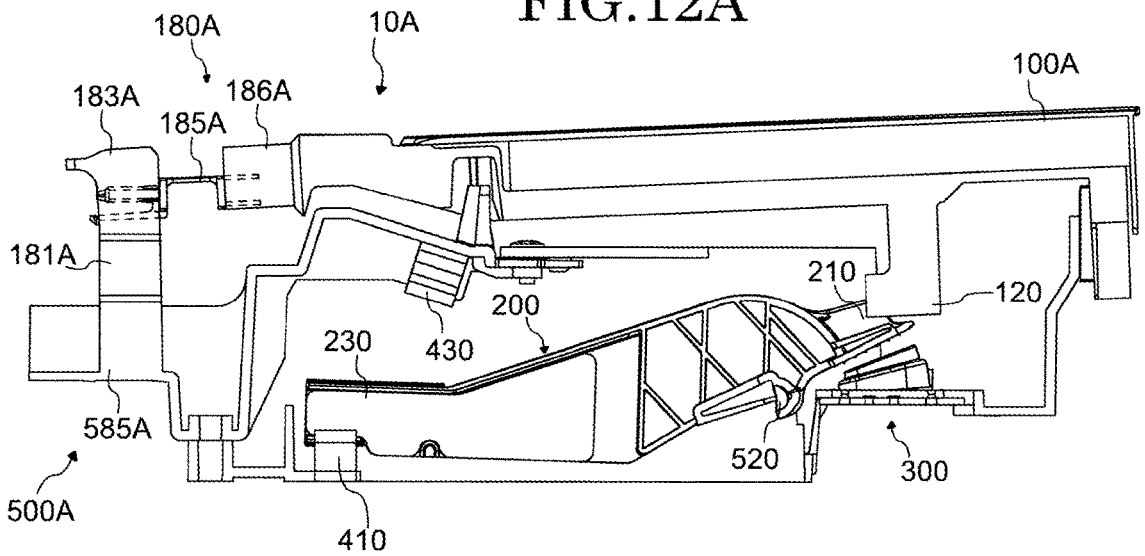
FIG. 12A is a view describing a structure of a keyboard assembly according to a second embodiment and a view of a case where a key is at the rest position (a state where the key is not pushed).
Figure 12B:
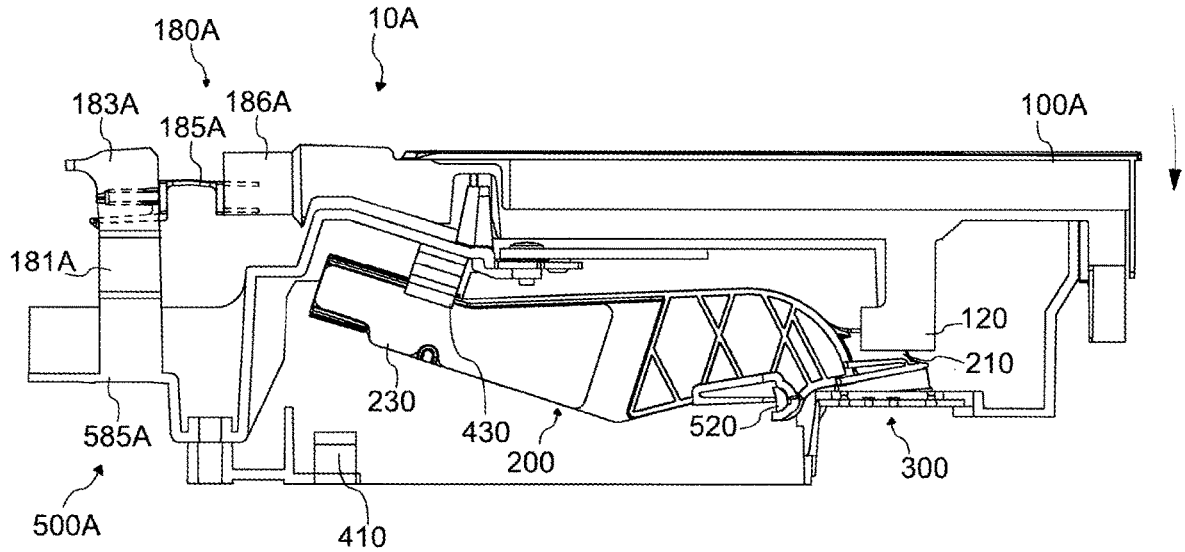
FIG. 12B is a view describing the structure of the key assembly according to the second embodiment and a view of a case where the key is at the end position (a state where the key is pushed up to the end).

FIGS. 12A and 12B are views for describing a structure of a keyboard assembly in the second embodiment. FIG. 12A is a view of when the key 100A is at a rest position (a state where the key is not pushed). FIG. 12B is a view of when the key 100A is at an end position (a state where the key is pushed to the end). The connecting portion 180A is provided with the plate-like flexible member 181A, a first supporting portion 183A, the rod-like flexible member 185A and a third supporting portion 186A.

In this example, the plate-like flexible member 181A connects the first supporting portion 183A and the second supporting portion 585A to each other. The plate-like flexible member 181A, the first supporting portion 183A and the second supporting member 585A are integrally molded from the same material. Even if such an arrangement is adopted, the plate-like flexible member 181A has flexibility in the scale direction S like the first embodiment. The third supporting portion 186A is a member connected to a back end side of the key 100A. The rod-like flexible member 185A is arranged between the first supporting portion 183A and the third supporting portion 186A. In this example, a longitudinal direction of the rod-like flexible member 185A is arranged so as to be approximately parallel with the front and back directions of the key 100A. The rod-like flexible member 185A and the first supporting portion 183A have structures similar to those of the first embodiment (the supporting rod, the engaging rod, and the like), so that they are attachable to and detachable from the each other. In this example, the rod-like flexible member 185A and the third supporting portion 186A are fixed to each other via a fixing member (the rod-like flexible member, and the like), but they may be configured to be attachable to and detachable from each other. By the rod-like flexible member 185A arranged in this manner, turning of the key 100 in the pitch direction is made possible.

When the key 100A is pushed, bending deformation directed below the key 100A occurs in the rod-like flexible member 185A, and the key 100A is turned around the rod-like flexible member 185A which is a turning center. Since the other configurations are similar to those of the first embodiment, respectively, explanations thereof are omitted.

It is to be noted that a turning center of a black key 100*b*A is arranged on the far side from a turning center of a white key 100*w*A even in the second embodiment like the first embodiment. Even in this case, it is desirable that a rod-like flexible member 185*w*A (corresponding to the rod-like flexible member 185A in FIGS. 12A and 12B) turning the white key 100*w*A has the same length as a rod-like flexible member 185*b*A turning the black key 100*b*A. That is, it is desirable that the rod-like flexible member 185*b*A is arranged on the far side from the rod-like flexible member 185*w*A.

Third Embodiment

In a third embodiment, a case where the key 100 and the plate-like flexible member 181 in the first embodiment are configured to be attachable to and detachable from each other will be described.

Figure 13A:
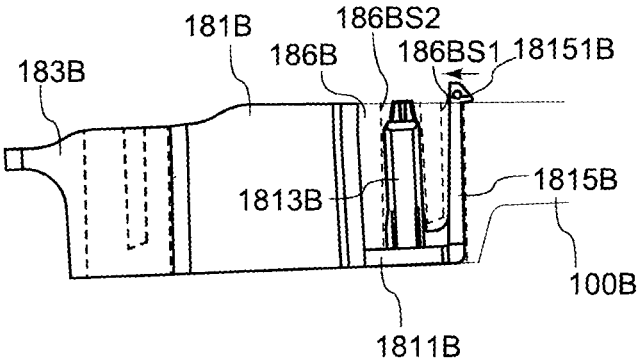
FIG. 13A is a view for describing a method for detaching a plate-like flexible member from other members in the third embodiment and a view showing a configuration present inside a third supporting member in an easily visible manner.
Figure 13B:
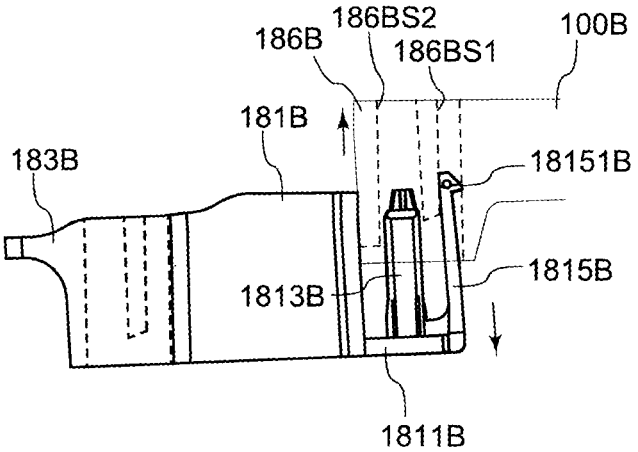
FIG. 13B is a view for describing a method for detaching a plate-like flexible member from other members in the third embodiment and a view for describing a stage in the middle of detaching a plate-like flexible member from the third supporting portion.
Figure 13C:
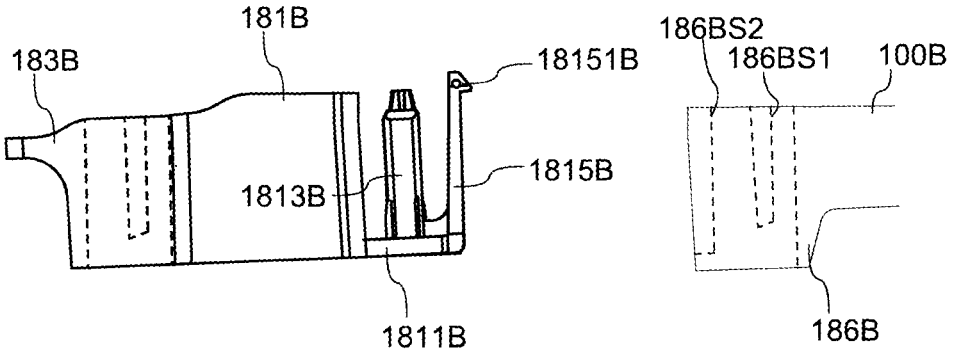
FIG. 13C is a view for describing a method for detaching a plate-like flexible member from other members in the third embodiment and a view for describing a state where the plate-like flexible member has been completely removed from the third supporting portion.

FIGS. 13A to 13C are views for describing a method for detaching a plate-like flexible member from other members in the third embodiment. FIG. 13A is a view showing a configuration present inside a third supporting member 186B in an easily visible manner. FIG. 13B is a view for describing a stage in the middle of detaching a plate-like flexible member 181B from the third supporting portion 186B. FIG. 13C is a view for describing a state where the plate-like flexible member 181 B has been completely removed from the third supporting portion 186B. A pedestal 1811B is connected to a front end side of the plate-like flexible member 181B. A supporting rod 1813B and an engaging rod 1815B are connected to the pedestal 1811B so as to extend upwardly. The engaging rod 1815B has an engaging portion 18151B at a top portion thereof.

The third supporting portion 186B is a member connected to a back end side of a key 100B. A first space 186BS1 and a second space 186BS2 extending through in vertical direction are formed inside of the third supporting portion 186B. The engaging rod 1815B is inserted into the first space 186BS1. The engaging portion 1815B is protruded from the first space 186BS1 upwardly. The engaging rod 1815B is caught on an upper surface of the third supporting portion 186B, so that the engaging rod 1815B is prevented from coming out of the third supporting portion 186B due to turning of the key 100. The supporting rod 1813B is inserted into the second space 186BS2.

A method for detaching the plate-like flexible member 181B from the third supporting portion 186B will be described. When a force is applied to the engaging portion 18151B toward the supporting rod 1813B in the state shown in FIG. 13A, the engaging rod 1815B having flexibility is bent, so that the engaging portion 18151B is moved up to a position where it can pass through the inside of the first space 186BS1. Then, when the third supporting portion 186B is moved to the plate-like flexible member 181B upwardly, as shown in FIG. 13B, the engaging portion

18151B passes through the inside of the first space 186BS1. When the third supporting portion 186B is further moved upwardly, the third supporting portion 186B and the plate-like flexible member 181B are separated from each other, so that the shape of the engaging rod 1815B is returned to an original shape of the engaging rod 1815B (FIG. 13C).

On the other hand, when the plate-like flexible member 181 B is attached to the third supporting portion 186B, the supporting rod 1813B is inserted into the second space 186BS2 from below, and, while the engaging portion 18151B is being inserted into the first space 186BS1 from below, the third supporting portion 186B is moved downwardly. At this time, since a distal end shape of the engaging portion 18151B has a slope, the engaging portion 18151B and the engaging rod 1815B are inserted into the first space 186BS1 while the engaging rod 1815B is being bent toward the supporting rod 1813B (FIG. 13B). When the third supporting portion 186B is further moved downwardly, the engaging portion 18151B is protruded from the first space 186BS1 upwardly and the shape of the engaging rod 1815B is returned to an original shape of the engaging rod 1815B, so that the engaging portion 18151B is engaged with an upper face of the third supporting portion 186B. Thus, it can also be said that the third supporting portion 186B and the engaging rod 1815B constitute a connector for connecting the plate-like flexible member 181B and the key 100B to each other attachably and detachably.

Modified Embodiments (1) In each of the embodiments described above, two flexible members (the first flexible portion close to the key and the second flexible portion close to the frame) are configured to be attachable to and detachable from each other. They may be molded integrally, they may be bonded to each other, or a configuration where they cannot be attachable to and detachable from each other may be adopted. In this case, the two flexible members may be made from materials different from each other. When the flexible members different in material from each other are molded integrally, the molding can be achieved by a so-called two-color molding (a double mold). Even in two flexible members which are not attachable to and detachable from each other, by selecting a combination of materials of the two flexible members appropriately, it becomes easy to control the touch feeling as compared with a case that the two flexible members are made from the same material.

(2) In each of the embodiments described above, the plate-like flexible member 181 and the rod-like flexible member 185 are included as two flexible members. Both of the flexible members may be plate-like flexible members, or the both may be rod-like flexible members. Further, one or both of the two flexible members may be flexible members having a shape other than the rod shape and the plate shape.

(3) In each of the embodiments described above, two flexible members are serially connected to each other between the key 100 and the frame 500. Three or more flexible members may be connected to one another. At this time, it is preferred that at least two flexible members of the three or more flexible members are serially connected to each other attachably and detachably. Therefore, some of the flexible members may not be connected serially and they may not be attachable to and detachable from one another.

(4) In each of the embodiments described above, for example, engagement performed by the engaging portion is utilized in the configuration where the plate-like flexible member 181 and the rod-like flexible member 185 are made attachable to and detachable from each other. The present invention is not limited to the engagement performed by the engaging portion. For example, a configuration of using a screw may be adopted, and further, a configuration using another structure body may be adopted. A structure where attaching and detaching of the plate-like flexible member 181 and the rod-like flexible member 185 can be performed by at least a predetermined operation, and the plate-like flexible member 181 and the rod-like flexible member 185 are bonded to each other in such an extent that the both are not separated from each other at a key operation (key pushing and key releasing) in the attached state of the both is only required.

(5) The turning center of the black key 100*b* and the turning center of the white key 100*w* may be the same position with respect to the far side direction. In this case, the size of the connecting portions 180*b*, 180*w* in the scale direction S is to be defined so that the connecting portions 180*b*, 180*w* can be arranged adjacent to each other.

(6) The regulation of the movement in the front and back direction of the key 100 has been realized by the side key guide 153, but may be realized by other guides.

REFERENCE SIGNS LIST

1 . . . keyboard apparatus
10, 10A . . . keyboard assembly
70 . . . sound source device
80 . . . speaker
90 . . . housing
100, 100A, 100B . . . key
100*w* . . . white key
100*b* . . . black key
120, 120*w*, 120*b* . . . hammer supporting portion
151, 151*w*, 151*b* . . . front end key guide
151*u* . . . upper key guide
151*d* . . . lower key guide
153, 153*w*, 153*b* . . . side key guide
1531, 1533 . . . protrusion
1535 . . . groove
180, 180A . . . connecting portion
181, 181*w*, 181*b*, 181A, 181B . . . plate-like flexible member
1811B, . . . pedestal
1813B . . . supporting rod
1815B . . . engaging rod
18151 B . . . engaging portion
183, 183*w*, 183*b*, 183A, 183B . . . first supporting portion
183S1 . . . first space
183S2 . . . second space
185, 185*w*, 185*b*, 185A . . . rod-like flexible member
1851, 1852 . . . pedestal
1853, 1854 . . . supporting rod
1855, 1856 . . . engaging rod
18551, 18561 . . . engaging portion
186A, 186B . . . third supporting portion
186BS1 . . . first space
186BS2 . . . second space
200 . . . hammer assembly
210 . . . front end
220 . . . shaft supporting portion
230 . . . weight portion
300 . . . sensor
410 . . . lower stopper
430 . . . upper stopper
500, 500A . . . frame
511 . . . front end frame guide
513 . . . side frame guide

520 . . . shaft
585, 585*w*, 585*b*, 585A . . . second supporting portion
585S1 . . . first space
586S2 . . . second space
586 . . . opening portion
590 . . . supporting column
710 . . . signal converting unit
730 . . . sound source unit
750 . . . output unit

What is claimed is:

1. A keyboard apparatus comprising:
a key;
a frame; and
a connecting portion having a first flexible portion, a second flexible portion serially connected to the first flexible portion between the key and the frame, and a connector for connecting the first flexible portion and the second flexible portion to each other attachably and detachably, the connecting portion turnably connecting the key to the frame by utilizing flexibility of the first flexible portion or the second flexible portion.

2. The keyboard apparatus according to claim 1, wherein the first flexible portion and the second flexible portion contain materials different from each other.

3. The keyboard apparatus according to claim 1, wherein the second flexible portion and the frame are attachable to and detachable from each other.

4. The keyboard apparatus according to claim 1, wherein the second flexible portion and the frame contain materials different from each other.

5. The keyboard apparatus according to claim 1, wherein the first flexible portion and the frame contain materials different from each other.

6. The keyboard apparatus according to claim 1, wherein either of the first flexible portion and the second flexible portion can be bent in an in-plane having a normal line extending in a scale direction, and the other thereof is not bent in the in-plane.

7. The keyboard apparatus according to claim 1, wherein either of the first flexible portion and the second flexible portion can be bent in an in-plane having a normal line extending in a scale direction and can also be bent in the scale direction, and the other thereof is not bent in the in-plane.

8. The keyboard apparatus according to claim 1, wherein the first flexible portion can be bent in a scale direction, and
the second flexible portion can be bent in an in-plane having a normal line extending in the scale direction.

9. The keyboard apparatus according to claim 8, wherein the first flexible portion is harder than the second flexible portion.

10. The keyboard apparatus according to claim 1, wherein the first flexible portion and the key are made from the same material.

11. The keyboard apparatus according to claim 1, wherein the first flexible portion and the key are attachable to and detachable from each other.

12. A keyboard apparatus comprising:
a key;
a frame; and
a connecting portion having a first flexible portion, and a second flexible portion different in material from the first flexible portion and serially connected to the first flexible portion between the key and the frame, the connecting portion turnably connecting the key to the frame by utilizing flexibility of the first flexible portion or the second flexible portion.

13. The keyboard apparatus according to claim 12, wherein
the second flexible portion and the frame are attachable to and detachable from each other.

14. The keyboard apparatus according to claim 12, wherein
the second flexible portion and the frame contain materials different from each other.

15. The keyboard apparatus according to claim 12, wherein
the first flexible portion and the frame contain materials different from each other.

16. The keyboard apparatus according to claim 12, wherein
either of the first flexible portion and the second flexible portion can be bent in an in-plane having a normal line extending in a scale direction, and the other thereof is not bent in the in-plane.

17. The keyboard apparatus according to claim 12, wherein
either of the first flexible portion and the second flexible portion can be bent in an in-plane having a normal line extending in a scale direction and can also be bent in the scale direction, and the other thereof is not bent in the in-plane.

18. The keyboard apparatus according to claim 12, wherein
the first flexible portion can be bent in a scale direction, and
the second flexible portion can be bent in an in-plane having a normal line extending in the scale direction.

19. The keyboard apparatus according to claim 18, wherein
the first flexible portion is harder than the second flexible portion.

20. The keyboard apparatus according to claim 12, wherein
the first flexible portion and the key are made from the same material.

21. The keyboard apparatus according to claim 12, wherein
the first flexible portion and the key are attachable to and detachable from each other.

* * * * *